US005822937A

United States Patent [19]

Mahony et al.

[11] Patent Number: 5,822,937

[45] Date of Patent: Oct. 20, 1998

[54] BRICK SUPPORT

[75] Inventors: Peter John Mahony; Campbell Seccombe, both of New South Wales, Australia

[73] Assignee: Boral Bricks (NSW) Pty. Ltd., New South Wales, Australia

[21] Appl. No.: 843,155

[22] Filed: Apr. 11, 1997

[30] Foreign Application Priority Data

Apr. 12, 1996 [AU] Australia ..... PN 9253

[51] Int. Cl.[6] ..... E04F 13/08

[52] U.S. Cl. ..... 52/386; 52/387; 52/389

[58] Field of Search ..... 52/222, 318, 319, 52/320, 321, 323, 384, 387, 385, 386, 389, 510, 513

[56] References Cited

U.S. PATENT DOCUMENTS

| | | | |
|---|---|---|---|
| 658,868 | 10/1900 | Rosenbaum | 52/387 |
| 1,106,168 | 8/1914 | Thomas | 52/387 |
| 3,019,560 | 2/1962 | Hansen | 52/389 |
| 4,011,702 | 3/1977 | Matyas | 52/387 |
| 4,026,083 | 5/1977 | Hoyt et al. | 52/387 |
| 4,773,201 | 9/1988 | Trezza | 52/387 X |

FOREIGN PATENT DOCUMENTS

| | | | |
|---|---|---|---|
| 190377 | 8/1986 | European Pat. Off. | 52/387 |
| 1130146 | 5/1962 | Germany | 52/387 |

*Primary Examiner*—Creighton Smith
*Attorney, Agent, or Firm*—Jenkins & Wilson, P.A.

[57] ABSTRACT

A support system (40) to support a plurality of bricks (42) which in combination with mortar (50) forms a wall. The support system (40) includes a sheet (43) provided with a plurality of generally parallel transversely spaced ribs (45), which ribs (45) are plastically deformed to provide a plurality of longitudinally spaced peaks (50 & 51). The bricks or tiles (42) are engaged between opposing peaks (50 & 51) to be retained in position thereby until the mortar (50) sets.

9 Claims, 2 Drawing Sheets

BRICK SUPPORT

TECHNICAL FIELD

This present invention relates to a support or backing for a brick array. The brick array may typically be a facing or cladding for a structure.

BACKGROUND OF THE INVENTION

It is known to provide a brick support system consisting of coated steel sheet formed with holes or tabs to provide a mechanical keying or interlocking engagement with the mortar of the brick facing. Metallic coated steel such as galvanized steel is ideally suited to the application because of its economy and strength but a known difficulty is the corrosion which occurs if there is any sustained collection of moisture on or adjacent the sheet, or if the sheets are occasionally in contact with moisture and have a large number of cut edges. The holes or tabs formed for keying purposes provide such multiple edges and thus create a corrosion problem.

OBJECT OF THE INVENTION

It is the object of the present invention to overcome or substantially ameliorate the above disadvantages.

SUMMARY OF THE INVENTION

The invention provides a support for a brick array, including:

a sheet to support a plurality of bricks or tiles to form a wall, said sheet having a plurality of generally parallel ribs which are transversely spaced, the ribs having transversely displaced brick or tile engaging portions, pan portions between the ribs, and wherein the transversely displaced portions of adjacent ribs are positioned to engage the brick or tile located adjacent the pan portion.

The metal sheet is preferably protectively coated steel sheet, most preferably metal coated steel sheet. The shaping of the sheet to form the rib(s) is preferably effected in a roll-forming operation.

The or each rib preferably has respective re-entrant recesses extending along both sides of the rib at the margins of the respective pans separated by the rib so that, viewed in cross-section, the rib exhibits an enlarged head undercut on both sides. The material of the sheet preferably curves smoothly about each recess and about this head so as to bound a cavity open to the face of the sheet opposite to that defining the pans and rib(s).

The rib is preferably of curved dovetail shape in cross-section.

Advantageously, the rib includes one or more zones reshaped to provide a drainage opening from one or both of said recesses and so to prevent moisture accumulation in the adjacent region of the recess. This zone may be provided, for example, by crimping a longitudinally extending portion of the rib.

Each of the pans is preferably provided with one or more outstanding and longitudinally extending flutes or flute segments to facilitate formation of a uniform mortar bed on the pan.

Advantageously, the ribs are formed so as there are no, or substantially no, internal cut edges, and therefore no apertures, slits or pressed out projecting sheet segments. The ribs are preferably separated by a space slightly larger than a brick width.

The invention also extends to an array of bricks, retained by mortar on a plurality of supports according to the invention.

There is further disclosed herein a method of forming a sheet to support a plurality of bricks or tiles to form a wall, said sheet being rolled to provide a plurality of generally parallel transversely spaced ribs, and plastically deforming the ribs so as to provide transversely displaced portions at spaced longitudinally positions along the ribs.

BRIEF DESCRIPTION OF THE DRAWINGS

The invention will be further described, by way of example only, with reference to the accompanying drawings, in which.

DETAILED DESCRIPTION OF THE PREFERRED EMBODIMENT

Figure 1:
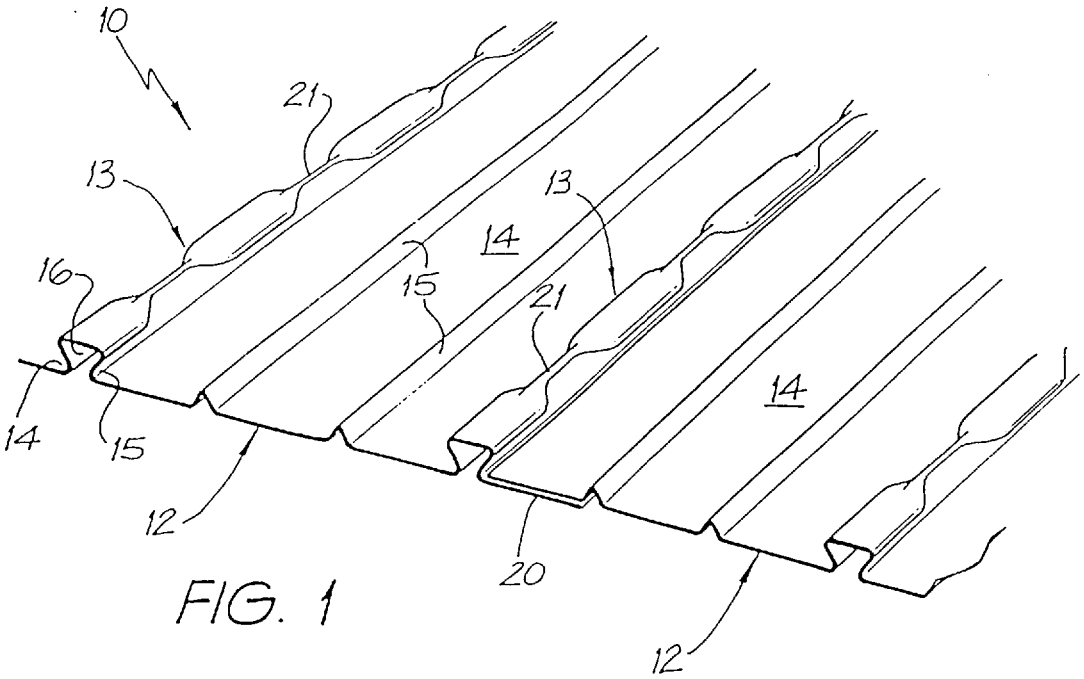
FIG. 1 is a perspective view of two similar, overlapped metal-coated steel sheets each forming a brick support according to an embodiment of the invention.
Figure 2:
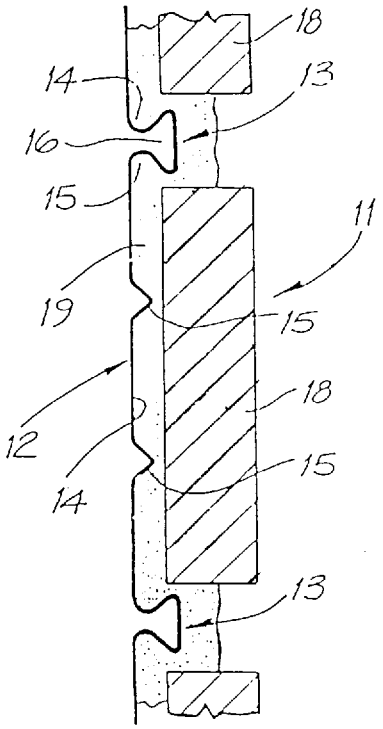
FIGS. 2 and 3 are respective partial vertical cross-sections of a brick support in situ with a mortared brick facing, respectively between and at a drainage zone.
Figure 3:
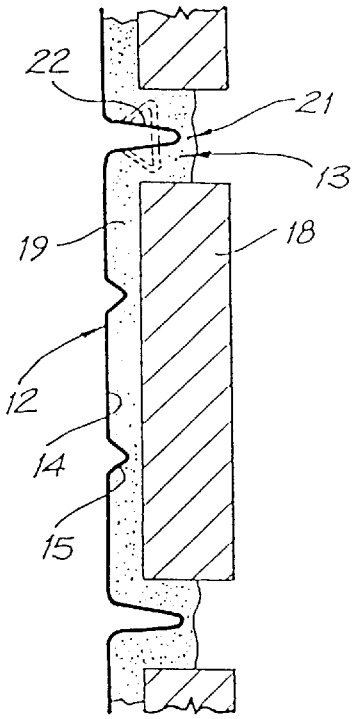

As illustrated in FIGS. 1 to 3, a support system 10 for a mortared brick facing 11 is formed from a number of lapped metal-coated steel sheets 12. Galvanized or zincalume steel sheet, of a gauge and specification to provide sufficient strength, would be suitable. The sheet is initially flat but is cold roll-formed to the cross-section shown in FIG. 2.

The thus rolled sheet 12 is formed at one side with a number of parallel longitudinally extending outstanding ribs 13 of outstanding ribs 13 which are of a non-constant cross-section with symmetrical curved dovetail shape in cross-section. These ribs 13 define and separate respective pans 14 which are in turn provided in the roll-forming operation with outstanding continuous flutes 15 which extend parallel to ribs 13 and are V-shaped in cross-section.

By virtue of the aforementioned shape, ribs 13 define respective re-entrant recesses 14, 15 extending along the respective sides of the rib. These recesses lie at the margins of pans 14 and it will be seen that the manner of forming ribs 13, by shaping the steel sheet to the configuration of the rib, means that each rib bounds an internal cavity 16 open at the rear face 17 of the sheet, opposite to the face defining panes 14 and ribs 13.

At their widest points, ribs 13 are separated by a distance a little greater than the average width of the bricks which the system is intended to support. To form the brick facing, a number of the sheets 12 would be fastened to an upright frame (not shown) and the courses of bricks 18 layed in a mortar bed 19 provided in the pans 14 and about the ribs 13, as shown in FIG. 2. These sheets are lapped as at 20 in FIG. 1. The curved dovetail cross-section of the ribs 13 and the presence of the re-entrant recesses 14, 15 facilitate a sound mechanical keying or locking engagement between the support sheet 12 and the mortar bed 19. The flutes 15 serve as spacer flutes to facilitate the formation of a uniform mortar bed and consequently a strong chemical bond between the brick facing and the mortar.

It will be appreciated from FIG. 2 that the upper re-entrant recess 14 of each rib 13 can act as a trap for excess moisture present in the mortar either initially or subsequently. To ensure against accumulation of such moisture in the recesses, and to allow any trapped moisture to drain away through the mortar bed, ribs 13 are provided at periodic intervals along their length with longitudinally extending crimped zones 21 in which the dovetail shape is flattened to in turn flatten each side of the rib to a sloping sheet segment 22 contiguous with the floors of the respective recesses. These crimped zones thereby form drainage outlets from the recesses. The space between the crimped zones is made sufficiently small to prevent any substantial moisture accumulation at the points midway between the crimped zones.

It will be appreciated that the illustrated embodiment provides mortar keying and spacer flutes, and guards against moisture accumulation, without having any exposed internal cut edges, i.e., cut edges within the body of the sheet. There are no such cut edges because there are no apertures or slits in the sheet and no tabs or other projections pressed from the sheet.

Figure 4:
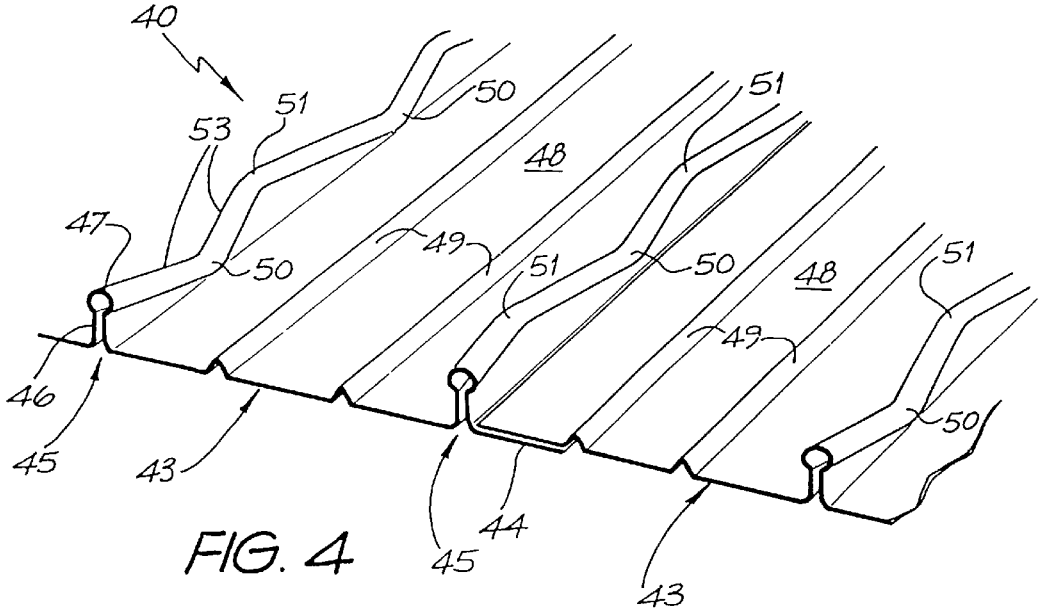
FIG. 4 is a perspective view of two further similar, overlapped metal-coated steel sheets each forming a brick support according to a further embodiment of the invention.
Figure 5:
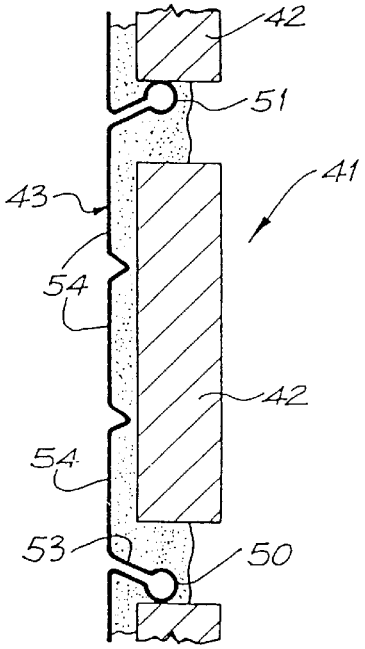
FIGS. 5 and 6 are respective partial vertical cross-sections of the bricks and support of FIG. 4.
Figure 6:
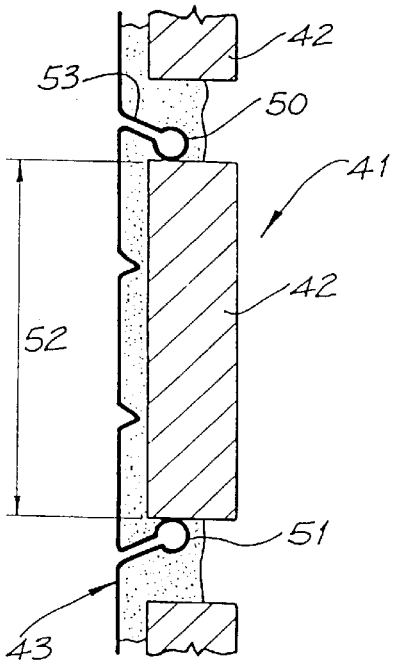

In FIGS. 4 to 6 there is schematically depicted a support system 40 for a brick facing 41 including discrete bricks or tiles 42. For example, the bricks 42 could be merely the face portion of a brick.

The system 40 includes overlapping rolled sheets 43 having overlapping portions 44. Each sheet 43 would be provided with a plurality of generally horizontally extending ribs 45. Each rib 45 would include a stem 46 terminating with an enlarged portion 47. Each rib 46 is hollow as the material falls in the sheet 43 is bent back upon itself in the process of forming the sheet 43. Extending between adjacent ribs 45 is a pan area 48 which is to receive each brick or tile 42. Each pan area 48 is provided with longitudinally extending flutes 49.

When the sheets 43 are initially formed, the ribs 45 are straight. However, in the process of forming the support system 40, the ribs 45 are plastically deformed so as to be deflected transversely so that a series of peaks 50 and 51 are formed thus providing the ribs 45 with a non-constant cross-section. The peaks 50 are generally downwardly projecting while the peaks 51 are generally upwardly projecting when the sheets 43 are secured so as to be generally vertically oriented to provide part of the wall of a building as best seen in FIGS. 5 and 6.

The distance between peaks 50 and 51 of adjacent ribs 45 is equal to or less than the width 52 of the brick or tile 42 so that the brick or tile 42 is secured in position with the ribs 46 elastically deformed so as to be urged into contact with the brick or tile 42 so that the brick or tile 42 is held in position while the mortar 50 cures to the extent at which the brick or tile 42 is secured to the associated sheet 43 by the mortar 50.

The flutes 49 provide for correct positioning of the bricks or tiles 42 and also aid in forming a uniform layer of mortar 50. Alignment of the peaks 50 and 51 also aids in aligning rows of bricks or tiles 42.

Deformation of the ribs 45 to form the peaks 50 and 51, provide sloping segments 53 which aid in draining moisture away from the pan portions 54 in order to ameliorate any problems associated with corrosion.

Informing the sheets 43, generally flat sheet material is rolled so that the ribs 45 are formed. Preferably, flutes 49 would be simultaneously formed. Thereafter, the ribs 45 are transversely plastically deformed to form the peaks 50 and 51 and segments 53.

We claim:

1. A sheet to support a plurality of bricks or tiles to form a wall, the sheet having a plurality of generally parallel and transversely spaced ribs, the ribs being of a non-constant cross-section and separated by pan portions, with each rib having a stem projecting outwardly from the adjacent pan portion, and a plurality of brick or tile engaging portions to engage the bricks or tiles to aid in securing the bricks or tiles to the sheet, the engaging portions of each rib being located at spaced intervals along the rib and being configured to project laterally beyond the stem toward the next adjacent ribs so as to engage bricks or tiles located between adjacent ribs.

2. The sheet of claim 1, wherein the ribs have sloping portions to drain the pan portions.

3. The sheet of claim 2, wherein each rib terminates with a longitudinally extending enlarged portion, the enlarged portion being plastically deformed to provide said engaging portions.

4. The sheet of claim 3 wherein said engaging portions of each rib are peaked and are displaced in alternate transverse directions at spaced locations along the rib.

5. The sheet of claim 4 further including an elongated flute located between adjacent ribs and extending generally parallel thereto.

6. A wall comprising the sheet of claim 5, said wall further comprising:

a plurality of bricks or tiles secured between the ribs; and mortar located between the bricks or tiles and the sheet, wherein the ribs are elastically deformed so as to be urged into contact with the bricks or tiles to said in retaining the bricks or tiles into position while the mortar sets.

7. A method of forming a sheet to support a plurality of bricks or tiles to form a wall, said method including the steps of rolling the sheet to provide a plurality of generally parallel transversely spaced ribs which are of a non-constant cross-section, and plastically deforming the ribs so as to provide transversely displaced engaging portions at spaced longitudinally positions along the ribs, the engaging portions being configured to engage bricks or tiles located between adjacent ribs.

8. The method of claim 7 wherein the ribs are crimped at longitudinally spaced locations to provide the transversely displaced engaging portions.

9. The method of claim 7 further including the step of plastically deforming the ribs so as to displace portions thereof transversely to provide peaks at longitudinally spaced locations along the ribs, with the peak projecting in alternate directions.

* * * * *